United States Patent [19]

Reed et al.

[11] Patent Number: 4,477,331

[45] Date of Patent: Oct. 16, 1984

[54] METHOD FOR RETORTING PARTICULATE SOLIDS HAVING RECOVERABLE VOLATILE CONSTITUENTS IN A ROTATING HORIZONTAL CHAMBER

[75] Inventors: Leland M. Reed, Loveland; William A. Reed, Cincinnati, both of Ohio; Walter C. Saeman, Cleveland, Tenn.

[73] Assignee: PEDCo, Inc., Cincinnati, Ohio

[21] Appl. No.: 495,423

[22] Filed: May 17, 1983

[51] Int. Cl.[3] ..... C10G 1/00; C10B 53/06

[52] U.S. Cl. ..... 208/8 R; 208/11 R; 201/16

[58] Field of Search ..... 208/8 R, 11 R; 201/16

[56] References Cited

U.S. PATENT DOCUMENTS

| | | | |
|---|---|---|---|
| 2,664,389 | 12/1953 | Rex et al. | 208/11 R |
| 3,481,720 | 12/1969 | Bennett | 208/11 R |
| 3,616,266 | 10/1971 | Hall et al. | 208/11 R |
| 4,094,769 | 6/1978 | Brown | 208/11 R |
| 4,285,773 | 8/1981 | Taciuk | 208/11 R |
| 4,302,207 | 11/1981 | Paspek | 44/1 SR |
| 4,344,836 | 8/1982 | Koch | 208/8 R |
| 4,347,119 | 8/1982 | Thomas | 208/8 R |

*Primary Examiner*—Delbert E. Gantz
*Assistant Examiner*—Lance Johnson
*Attorney, Agent, or Firm*—Wood, Herron & Evans

[57] ABSTRACT

A method and apparatus is disclosed for retorting particulate solid materials, particularly hydrocarbon-containing materials such as oil shale, oil sands, tar sands, coal shale, coal tailings, and the like, for the recovery of a volatile constituent such as oil or gas. A rotary retorting apparatus is employed which consists of a cylindrical drum, or other similar regularly shaped chamber, with a substantially horizontal axis of rotation and having multiple compartments for retorting and combustion and, optionally, spent solids cooling. The apparatus further includes solids transport chutes for forward and backward circulation of solids, arranged for the intercompartmental transfer of solids with the capability of additions at one or more points in each compartment. Employing the method and apparatus, particulate solids feedstock is heated by recycled spent solids material to remove the volatile constituent of the feedstock in the retort section. Another feature of the invention employs direct solids-to-gas contact established by lifting and cascading reacting solids through hot gas streams such that throughput, high thermal efficiency, low energy input, among other advantages, are obtained in producing high yields of volatile product. In particular, high oil yields and gas yields are obtained when processing oil shale, but with low sulfur oxides, nitrogen oxides in the flue gases and reduced hydrogen sulfide in the retort gases.

31 Claims, 9 Drawing Figures

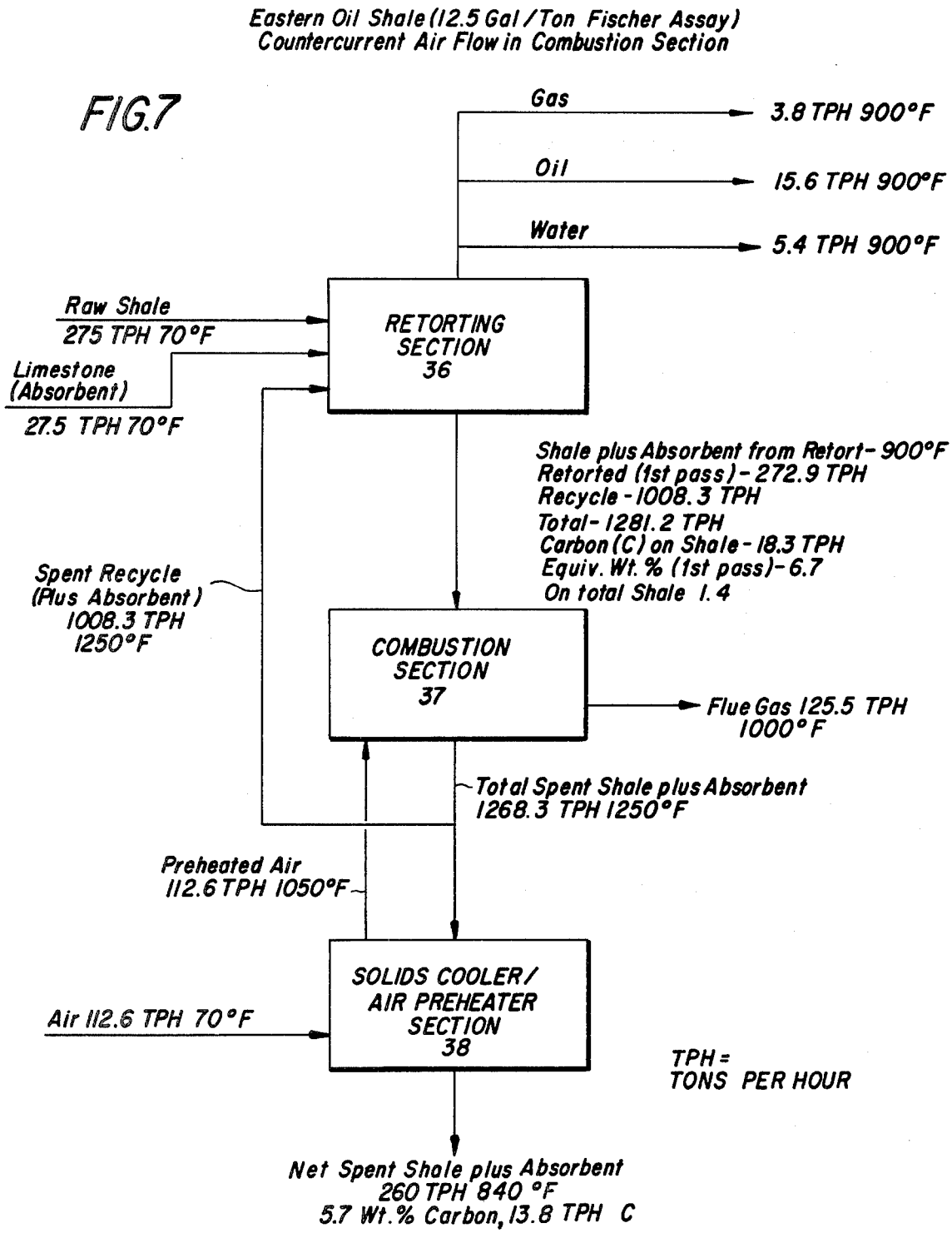
Eastern Oil Shale (12.5 Gal/Ton Fischer Assay)
Countercurrent Air Flow in Combustion Section
FIG.7
Gas
3.8 TPH 900°F
Oil
15.6 TPH 900°F
Water
5.4 TPH 900°F
Raw Shale
275 TPH 70°F
Limestone
(Absorbent)
27.5 TPH 70°F
RETORTING
SECTION
36
Shale plus Absorbent from Retort - 900°F
Retorted (1st pass) - 272.9 TPH
Recycle - 1008.3 TPH
Total - 1281.2 TPH
Carbon (C) on Shale - 18.3 TPH
Equiv. Wt. % (1st pass) - 6.7
On total Shale 1.4
Spent Recycle
(Plus Absorbent)
1008.3 TPH
1250°F
COMBUSTION
SECTION
37
Flue Gas 125.5 TPH
1000°F
Total Spent Shale plus Absorbent
1268.3 TPH 1250°F
Preheated Air
112.6 TPH 1050°F
SOLIDS COOLER/
AIR PREHEATER
SECTION
38
Air 112.6 TPH 70°F
TPH =
TONS PER HOUR
Net Spent Shale plus Absorbent
260 TPH 840 °F
5.7 Wt.% Carbon, 13.8 TPH C Coal Shale
Co-Current Air Flow in Combustion Section

METHOD FOR RETORTING PARTICULATE SOLIDS HAVING RECOVERABLE VOLATILE CONSTITUENTS IN A ROTATING HORIZONTAL CHAMBER

BACKGROUND OF THE INVENTION

Numerous solid materials contain valuable and recoverable volatile constituents which may be recovered by retorting. In particular, hydrocarbons and other carbonaceous materials offer a significant source of materials which may be retorted to recover valuable components. There are many abundantly available minerals from which hydrocarbons may be practically recovered by retorting or pyrolysis, including oil shale, oil and tar sands, bituminous and subbituminous coals, coal shale and coal tailings.

Oil shale is a very abundant mineral made up of volatile organic constituents and inorganic minerals. The organic portion, called kerogen, is a high molecular weight polymer cross-linked in three dimensions and insoluble in solvents. The mineral portion of certain shales such as western shales, for example, is about half dolomite and calcite, i.e., carbonates of magnesium and calcium which calcine to MgO and CaO at sufficiently elevated temperatures. The remainder of the mineral matrix usually contains about 10–15% silica and silica alumina compounds containing sodium, potassium or calcium and about 1–5% of iron sulfide. Since the kerogen cannot be dissolved or washed out of the shale with solvents, it is commonly converted to oil, gas and coke by destructive distillation in a shale retort. Thus, crude shale oil and gas may be produced by heating oil shale to about 700° F. or higher. Oil and gas so produced will be typically processed for nitrogen and sulfur compound removal in subsequent upgrading operations. The carbonaceous residue which results from the retorted shale may be burned for heat recovery, but this is not yet commercially common.

The oil shale retorting industry has special characteristics and requirements. To begin with, solids mining and processing rates are enormous. For example, all mining in the United States totalled 3 billion tons in 1976. Recovery of 600,000 barrels per day of oil shale would correspond to mining 0.3 billion tons per year or 10% of all United States' mining, but only 3% of United States' oil consumption. Compared to petroleum refining, high heat loads exist in oil shale retorting because sensible heat must be supplied to the minerals, which amount to about 80 weight percent of the shale for American shales. Complete air-solids contacting is required in burning and the carbon is 150% greater than in a fluid bed catalytic cracker of equivalent oil feed. For example, a 50,000-barrel-per-day shale retorting plant will require as much air and burn as much carbon as a 125,000-barrel-per-day catalytic cracker. High overall thermal efficiency is also important. The residual carbon contains between 10 and 50% of the total Btu's available in raw shale depending upon the origin of the shale. Among other special considerations in retorting oil shale, one must provide an ability to handle rich shale without agglomeration and raw shales with a wide range in kerogen content.

Currently known processes for retorting shale can be classified into four main types according to the method of supplying heat to the retort as reported in Atwood, M. T., "Above-Ground Oil Shale Retorting: The Status of Available Technology", *Engineering and Mining Journal*, Sept., 1977; and Nowacki, D., Editor "Oil Shale Technical Data Handbook"; Noyes Data Corp., Parkridge, N.J., 1981. In brief, Types 1 and 2 retorts involve heating of shale by gas. As a consequence, the retort off-gas is diluted with flue gas to give a typical 120-Btu-per-cubic-foot gas which is generally not saleable. Examples of the Type 1 retort are the Paraho direct process and the Superior Oil circular-grate process. In a Type 2 retort, recycle retort gas is preheated indirectly to approximately 1200° F. before entry into the retort. Because the recycle gas is undiluted with flue gas, heating values above 800 Btu per cubic feet are attainable. Part of the retort gas is burned to heat the recycle gas. Union Retort Type B and Union Oil SGR-3 processes are examples of a Type 2 retort. The Type 3 retort is characterized by the recirculation of hot ceramic balls to supply retort heat. TOSCO II is the foremost example of this type. Finally, a Type 4 retort is characterized by the recycle of spent shale from the combustor to supply retort heat. Lurgi-Ruhrgas and Chevron processes are examples of this type and they require lift-combustors where the solids are lifted by compressed air which is costly. In view of the brief overview of the above background and prior art in connection with the retorting of solid materials, especially hydrocarbon-containing minerals, for the purpose of recovering volatile components therefrom for isolation and reuse, further improvements are desirable. In substance, there are demands for new apparatus and methods for the retorting of such materials with high efficiencies in order to overcome the disadvantages associated with known techniques and devices.

SUMMARY OF THE INVENTION

In one of its main aspects, this invention provides an improved apparatus and method for the recovery of volatile constituents from solid materials. The method and apparatus is especially suited for handling of hydrocarbon-containing feedstock such as oil shale for the purpose of recovering oil and gas having a very useful heat value. Many of the disadvantages associated with the above-described systems of the prior art are eliminated according to the principles of this invention. Furthermore, this invention provides a method and apparatus for optimizing heat transfer, solids and gas contacting, and solids transport in retorting solids materials. These advantages and other advantages will become apparent in view of the detailed description which follows.

In one preferred form, the apparatus of this invention comprises a rotary chamber, i.e., a cylindrical drum, or other similar regularly shaped chamber, suitable for rotation about a substantially horizontal axis. The drum is divided into at least two compartments or sections which are in series with one another. These compartments include a retorting section and a combustion section. Optionally, and integrally associated with the rotary apparatus, there may be included a solids cooler section which preferably is combined with the capability of preheating air and the combined section is referred to herein as "solids cooler/air preheater section". It is important that the retorting section be separated from the combustion section according to the operation of this invention as will become apparent from this description. However, in other embodiments of the present invention, the combustion section need not be physically divided from the solids cooler/air preheater section. For a completely integral unit in accordance with the best embodiment of this invention, the rotary unit integrally includes a chamber having a retorting section, a separate combustion section and a solids cooler/air preheater section, all in series, for economical and efficient recovery of volatile components.

The method for retorting a feedstock of particulate solids having a recoverable volatile constituent employing the rotary elongated chamber above mentioned involves the following steps. The feedstock solids are first introduced into the rotary elongated chamber which is adapted for rotation about a substantially horizontal axis. The chamber has an inlet and an outlet with at least a retorting section and a separate combustion section. The sections are in series with one another. As the chamber is rotating about its axis, feedstock solids are passed through it from the retorting section to the combustion section. Feedstock solids are subjected to combustion in the combustion section and hot spent feedstock solids are recycled from the combustion section to the retorting section. In the retort section, feedstock solids are mixed with the hot spent recycle solids to volatilize at least one constituent of the feedstock solids. Thereupon, the volatilized constituent is then recovered.

There are other further preferred features of the practice of the invention. For instance, the devolatilized feedstock solids as mixed with the recycled spent solids are transferred to the combustion section. In addition, a further aspect of the invention comprises lifting and cascading devolatilized feedstock solids mixed with recycled spent solids through a moving stream of preheated air introduced into the combustion chamber and burning any residual combustible material in the devolatilized feedstock solids. In another aspect, the rotary chamber is provided with a combined solids cooler/air preheater section in the series after the combustion section, as mentioned above, and ambient combustion air is passed through said preheater section prior to introduction into the combustion section. Furthermore, fully integrated in the above methods there additionally includes other features such as recycling a portion of the hot spent solids from a downstream end of the combustion section to a feed end of the retorting section, transferring the remaining hot spent solids to a front end of the solids cooler/air preheater section, introducing the ambient combustion air into a discharge end of said solids cooler/air preheater section, cooling said spent solids in a countercurrent flow of combustion air while simultaneously preheating said combustion air, transferring said preheated combustion air to an upstream end of the combustion section, and removing the spend solids from the discharge end of the solids cooler/air preheater section.

Thus, the apparatus and method of this invention provides for a fully continuous and integrated process where feedstock solids of a particulate form having a range of sizes, limited only by the size and dimension of the apparatus for passage of the solids therethrough, has been provided. The present invention offers a very distinct advantage in that it provides for direct transfer of process heat. Hot recycled spent shale provides the heat necessary to drive the oil from the incoming shale feedstock without the necessity of a secondary medium such as ceramic balls. Moreover, high rates of heat and mass transfer result in relatively small volume units compared to conventional units. The combustion of the residual residual carbon remaining after release of the oil vapors and gas, and recovery of heat from the spent shale by preheating incoming combustion air, contribute to high thermal efficiency of the process. This is further increased by some additional recovery of heat from the flue gases indirectly by heat exchange with the incoming air, since the hot flue gas duct may also be constructed to traverse solids cooler/air preheater section. The hot flue gases may also be sent through a wasteheat boiler for generation of process steam or to provide other heat recovery. Moreover, another advantage of this invention is that the raw shale or other sticky feedstock is prevented from agglomerating in the unit by the recirculation of spent shale which acts as a coating agent for sticky materials which may be formed or released in the retorting section, thus keeping the shale free-flowing. Also, the transport of solids through the unit is accomplished without high energy requirements that are characteristic of other conventional systems.

The feedstock solids which may be processed according to the method and apparatus of this invention vary over wide classes of chemical constitution. Any feedstock solid which may be retorted wherein it is desired to recover a volatilized constituent may be employed. A preferred class of such feedstock solids include hydrocarbon-containing minerals. Particularly included in this class are those selected from the group consisting of a calcite-containing oil shale, a non-calcite containing oil shale, oil sand, tar sand, coal shale, coal tailings, wood, coal, and mixtures of such materials. In fact, this invention is especially directed to the recovery of oil and/or usable by-product gas from the mentioned mineral oil sources. A further advantage of this present invention is that the fresh feedstock shale, for example, is heated with recirculated hot spent shale which derives its own heat from the combustion of the carbonaceous residue or char in the spent shale itself. Therefore, all of the oil and approximately 800 to 1000 Btu higher heating value gas driven from the fresh shale feedstock are recoverable and available for sale after removal of sulfur-containing compounds. Thus, the high heating value gas which exits the retort section is undiluted with flue gases as is the case in the Paraho and the Superior Oil processes and is available as a saleable by-product material. Furthermore, the Paraho process claims to recover only 95% of the Fischer assay with assays up to 35 gallons per ton of shale and it would appear, accordingly, that some shale oil is burned in situ in the retort. This does not take place in the present invention because substantially all of the oil is already driven off in the retorting section and, thus, it does not enter the combustion section.

Undesirable chemical constituents such as sulfur-containing compounds like hydrogen sulfide, sulfur oxides, and others, are also capable of being removed from processed solids. For instance, with calcite-containing shale such as western United States shale, sulfur dioxide in flue gases, formed by oxidation in the combustion section of the sulfur remaining in the carbonaceous residue after retorting, plus the pyrites in the mineral content of the raw shale, are substantially adsorbed by the calcium oxide and to some extent by the magnesium oxide generated in the combustion section from the dolomite and calcite in such shale. In the case of other non-calcite-containing shale such as the eastern United States shale, by the addition of supplemental limestone or dolomite or other absorbent, adsorbent, or reactant, such sulfur-containing compounds may be removed.

This is accomplished by operating at temperatures favorable to such $SO_2$ sorption such that over 90% may be sorbed, thus eliminating an important environmental problem. Moreover, there is evidence that some of the $H_2S$ formed in the retort section from the sulfur content of the kerogen is sorbed by the calcium and magnesium oxides introduced into the retort section with the recirculated spent shale. This in turn reduces the amount of $H_2S$ which must ultimately be removed from the high heating value retort gas. The favorable operating temperatures in the combustion section are maintained between about 1200° F. and 1600° F. for such purpose. Furthermore, operating at such temperatures reduces the formation of nitrogen oxides in the flue gases as well as providing efficient sorption of sulfur oxides by the limestone, dolomite or burnt lime components introduced with the feed.

While the recovery of oil from shale is an advantage of the present invention, such oils may be recovered in vapor form so as to not contain finely divided droplets. Thus, electrostatic precipitators for the separation of oil, as is the case of the Paraho and Superior Oil systems, are not required. Furthermore, owing to the fact that retort oil and gas are undiluted with hot flue gases, less water is required for cooling. Furthermore, the cooling of hot spent shale, for example, is accomplished during the preheating of the combustion air to the combustion section. This exemplifies the conservation of heat and energy in accordance with the preferred practices of this invention.

This invention lends itself to the use of a superheated steam retorting process having a number of advantages: reduction of retorting temperature; the spent shale is more acceptable for land fill because of lower alkalinity, lower solubility silicates and good setting properties as a cement; the hydrogen yield is substantially increased, thereby the hydrogen required outside of the retort to hydro-treat the raw shale oil for nitrogen and sulfur removal; with an increase in hydrogen content, the carbon monoxide is also reduced in accordance with the water-gas shift reaction; and the pour point and density of the oil are reduced. For instance, in processing western United States shales, the present invention would discharge spent shale at approximately 600° F. after air preheating. If this material were quenched with water to cool it to approximately 300° F., about 102 pounds of steam at 250° F. or higher would be generated per ton of shale and this could be sent directly to the retort section. Therefore, this invention provides additionally superheated steam to said retort section as an integral part of the process.

A further advantage of the present invention is that it offers a simple, compact design which combines the retorting section, combustion section, and solids cooler-/air preheater section into a single unit. This contrasts with the TOSCO II system mentioned above which has separate rotating drum units for pyrolysis and spent shale cooling, a separate fuel consuming combustor for heating the ceramic balls characteristic of that process, and an elevator for raising the recycled ceramic balls to the ball heater. Furthermore, internal or external recirculation chutes are provided by this invention which permit recirculation of hot spent shale, for example, from the discharge end of the combustion section to the feed end of the retort section for the purpose of furnishing retorting heat to the raw shale. In this invention, this recirculation is accomplished in a considerably simpler and more energy-efficient manner than in the Lurgi-Ruhrgas or the Chevron processes, for example. In both of the latter mentioned systems, spent shale is recycled by a lift pipe in which the solids are lifted by the motive power of air which requires compression of the air with its resultant high costs. The recirculation arrangement in the present invention is similar to a worm-type recirculating means and requires no separate driving arrangements other than rotation of the chamber or drum of the apparatus itself.

The operating temperatures of the preferred apparatus of this invention, and the temperature balance in the processing of hydrocarbon-containing minerals is such that the quantity of recycled hot spent solids provides a temperature of about 700° F. to about 1000° F. in the retorting section, preferably with the recycle temperature of about 1200° F. to about 1600° F. and a feedstock solids temperature of about room temperature, i.e., 70° F. The temperature in the combustion section is maintained between about 1200° F. and 1600° F., as mentioned above. Such temperatures still present another advantage of this invention in that those minerals and spent shale may be calcined at approximately 1200° F. in the combustion chamber which produces a desired cementability of the spent shale. Such material, when used in land fill operations exhibits low permeability, minimum leaching by rainfall and low erosion.

Most of the conventional oil shale retorting processes are adversely affected by fines in the raw shale feed. This is particularly true of the Paraho, Superior Oil and Union Oil B processes where segregation of the fines in the retort causes uneven distribution of the hot retort gases through the bed and/or high pressure drop. As a result, removal of fines from the feedstock must be carried out with its inherent cost. Also the fines inherently generated during processing further contribute to operating difficulties. In the present invention, the raw shale feed stock may possess a broad range of particle sizes. The nature of the "mechanical fluidization" produced by cascading the solids through the hot gas stream is such that the feedstock shale does not have to be screened to remove the fines. In the apparatus described herein, all particle sizes are treated virtually the same as far as the retorting and combustion are concerned and, thus, run-of-the-mill crushed shale, for example, can be readily processed.

A further advantage of the present invention in processing oil shale, for example, is that high oil yields are obtainable, sometimes in excess of the Fischer assay. In this invention, suitable flexibility is inherent in the design to permit optimum adjustment of the temperature in the retort section, the recirculated spent shale temperature, the rate or recirculation of spent shale, and the residence time in the retorting section. Another advantage of this invention is that a lower pour point oil may be produced by western shales, for example, which normally produce oils with high pour points. This is due to favorable catalytic reactions which take place in the retorting section when the fresh shale feedstock is exposed to silica and alumina compounds inherent in the spent shale which are activated in the combustion section.

In another embodiment, the invention may be arranged to operate with a combustion section in countercurrent mode. In this arrangement, there is no separate solids cooler/air preheater section but rather the flue gas duct extends from the spent shale discharge and to a point close to the front end of the combustion zone. The preheated air ducts which are present in the cocurrent arrangement and which join the solids cooler/air preheater section with the front end of the combustion section are eliminated so that incoming air first progresses toward the feed end of the combustion section from the lowest carbon content to the highest carbon content or least burned-out shale. The flue gases leave the combustion section through the flue gas duct.

In still another embodiment of the present invention, it may be arranged to operate with oil sands or tar sands as a raw material. Typically, for Athabasca oil sands, the bitumin content runs between 6 and 18% with a sulfur content averaging about 4.5%. The assay is about 30 gallons per ton of oil sand. The mineral content is comprised of 99% quartz sand plus clay, the remaining 1% being mostly calciferous. In those cases where the residual carbon produced from oil sand is not sufficient in quantity to supply the required retorting heat the additional heat may be provided by the addition of coal or subcoal such as lignite, for example, or any available fuel such as a carbonaceous fuel or a gas. A portion of the heat may also be supplied by burning the retort gas in the combustion section as well. Because of a high sulfur content and low calcium and magnesium contents of the oil sand, supplemental sorbents such as limestone, as mentioned above, may be added to the fresh feed to control the sulfur-containing compounds in the combustion section.

In a further practice of this invention, coal shale and coal tailings, as mentioned above, may also be used as feedstock for recovery of hydrocarbons or volatilized constituents. Although both of these materials are lower in carbon content than coal, they are nevertheless much richer than oil shale or oil sand. In this case, more residual carbon is produced in the retort section than is necessary to supply the heat requirement and thus the residual carbon is only partially burned, yielding a by-product high in carbon suitable for firing steam generators, for example. Again, limestone may be added to the feedstock to control sulfur-containing compounds formed in the combustion section.

Another unique feature of this invention is that the rotary apparatus, for instance, a cylindrical drum or other regular shape, is rotated about its horizontal axis at a suitable speed to allow the solids to become "mechanically fluidized" in the combustion section and to cascade down through the flue gases formed by combustion, entraining gases during this operation. The cascading action of the hot, burning solids establishes intimate contact with the gases formed in the combustion section in a manner somewhat analogous to the contact in a fluidized bed and as mentioned herein it may be said analogously that the solids become "mechanically fluidized". The speed of rotation of the drum that gives suitable mechanical fluidization of the cascading solids is dependent on the radial height of the lifters and may be described by the following empirical equation for lifters up to about 1/10 the diameter of the drum:

$$\text{Revolutions per minute} = A\sqrt{\frac{3}{\text{internal diameter in feet}}}$$

In the above, under many circumstances, the term A may vary between 10 and 40 with satisfactory results, with values of 15 to 25 being preferred.

Such mechanical fluidization achieves uniform contact of solids with the combustion gases in the combustion section, and if desired in the solids cooler/air preheater section, irrespective of particle size and at low gas pressure drop through these sections. Such mechanical fluidization of the spent mineral solids in the combustion section in progressive stages of ignition and combustion from the feed end to the spent mineral discharge end assures efficient conditions of combustion for the residual carbon in the spent material from the retort section, as well as for any volatile compounds remaining in the spent mineral. This phenomenon which might also be referred to as cascade turbulence throughout the combustion section intensifies and accelerates the combustion process, thereby assuring a compact and low-cost apparatus. It will therefore become evident that this invention provides a means for transferring solids from a retort section to a combustion section of a rotary apparatus, and from the combustion section to the solids cooler/air preheater section, without consuming energy in the transfer devices except for the rotation of the rotary apparatus or drum itself and without the necessity for complex external or internal transfer devices. Employing the apparatus of this invention, solids recycle chutes and ducts are an integral part of the assembly to assure economy in construction, erection and operation of the system. In this connection an apparatus is provided in which the high rates of heat and mass transfer result in a very efficient use of volume, thus reducing the required size of the apparatus. This invention, its objectives and many advantages, may be further understood by reference to the following detailed description with reference to the accompanying figures.

BRIEF DESCRIPTION OF THE DRAWINGS

FIG. 7 is a flowsheet describing a system wherein the present invention is used to retort eastern oil shales for the purpose of recovering shale oil and high heating value gas, and in which the combustion air travels countercurrently with respect to the burning solids in the combustion section.

DETAILED DESCRIPTION

Figures 1, 2:
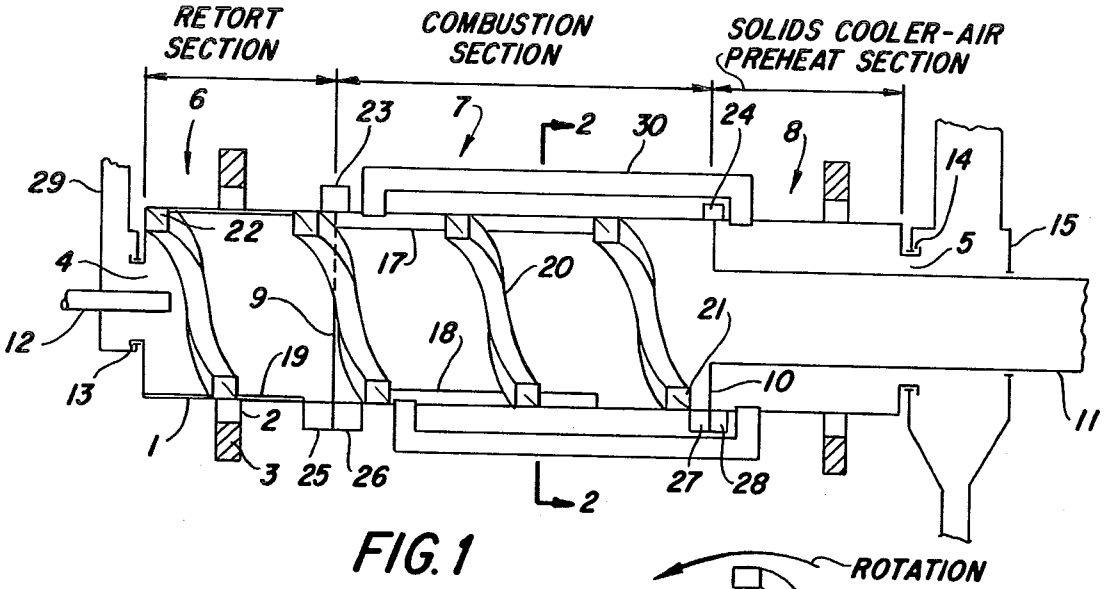
FIG. 1 is a side elevation of a cylindrical rotary shale retorting apparatus of the present invention wherein the combustion air is designed to travel in a cocurrent manner with respect to spent shale in the combustion section. This elevation is shown in cross-section taken through the longitudinal axis of the cylinder by a vertical plane.
FIG. 2 is an end elevation of FIG. 1 in cross-section taken approximately through the mid-point of the cylinder looking toward the discharge end along lines 2—2.

FIG. 1 depicts one example of a rotary retorting apparatus in accordance with the principles of this invention. The following description relates to the use of oil shale as a feedstock for the apparatus and it is intended merely to illustrate the invention without limiting its scope. Other solid materials having a recoverable volatile constituent may be employed without departing from the spirit and scope of this invention.

The retorting apparatus of FIG. 1 includes a cylindrical chamber 1 supported for rotation by tires 2 and trunnions 3 in a manner well known in the art. A variable-speed driving means (not shown) of conventional structure is provided for rotation of the chamber 1. The retorting apparatus is provided with a feed opening 4 and a discharge opening 5. The chamber 1 is divided into a retorting section 6 and a combustion section 7, and a solids cooler/air preheater section 8. The retort section 6 is separated from the combustion section by a solid intercompartmental divider 9. The combustion section 7 is similarly separated from the solids cooler-/air preheater section 8 by a solid divider 10 through which passes the flue gas discharge duct 11. Chute 12 delivers oil shale or other hydrocarbon-containing feedstock and, if necessary, other solids materials to the apparatus. Rotating seal 13 closes and seals opening 4 from the outside atmosphere in a conventional way. Similarly, rotating seal 14 seals opening 5. Stationary air duct 15 introduces combustion air through opening 5. Decarbonized spent shale is discharged through chute 16.

The chamber 1 is lined with a refractory heat-resistant material 17 of a type suitable to withstand the maximum temperatures attained during combustion. A plurality of rigid lifting plates 18 are attached to the interior wall of the combustion section 7 and project perpendicularly from said wall. These lifting plates 18 are oriented parallel to the axis of rotation and extend almost the whole length of the combustion section 7. Similarly, lifters 18 are mounted in the solids cooler/air preheater section 8. In this example, with a chamber diameter of 20 feet, the lifters 18 may be 10 to 12 inches in depth. Mixers 19 are also mounted in the retorting section, but these differ from lifters 18 in the fact that mixers 19 do not extend as far from the interior wall as do lifters 18. For this example, with a 20-foot diameter chamber, mixers 19 may be 1 to 3 inches deep. A recycling means consisting of at least one helical chute 20 is mounted along the inside wall of chamber 1 and is open ended at its inlet end 21 and its outlet end 22, but the remainder of the chute is closed off from the combustion section 7 while it passes through it and from the retort section 6. The helical chute 20 curves around the chamber 1 in a direction counter to the direction of rotation so that material entering inlet 21 is carried back toward feed opening 4 until it is discharged through outlet 22.

A similar helical chute 23 is mounted on the outside of chamber 1 to permit transfer of solids between the retort section 6 and combustor section 7. Similarly, another helical chute 24 permits transfer of solids between the combustion section 7 and the solids cooler-/air preheater section 8. Helical chute 23 has its inlet opening 25 in the retort section 6 and its outlet opening 26 in the combustion section 7. Similarly, helical chute 24 has its inlet opening 27 in the combustion section and its outlet opening 28 in the solids cooler/air preheater section 8. Both helical chute 23 and helical chute 24 curve around chamber 1 in the same direction as the direction of rotation so that material entering inlet 25 is carried forward toward the combustion section 7 until it is discharged through outlet 26 and, similarly, material entering inlet 27 is carried forward toward the solids cooler/air preheater section until it is discharged through outlet 28. Both of these intercompartmental helical chutes, 23 and 24, are arranged with conventional devices (not shown) which permit solids to pass, but prevent gases from flowing through them.

In operation, hydrocarbon-containing minerals such as western and eastern oil shales, oil or tar sands, coal shale, coal tailings, etc., may be mixed with one or more additives to remove contaminants from the retorting and combustion process. Eastern shale, for example, may be mixed with limestone or dolomite, for example, to remove sulfur compounds in the retort section 6 and the combustion section 7. The amount of limestone or dolomite which must be added to the process is proportional to the sulfur content of the shale. This proportion, based upon the molar ratio of calcium to sulfur, generally ranges between 1 and 4 to 1. The feedstock mixture is fed through delivery chute 12 into the front end of retort section 6. Here it meets hot recycled spent shale at a temperature of approximately 1200° F., transferred from the discharge end of combustion section 7 through recycle chute 20 and the two are intimately mixed with the aid mixers 19, but not so much as to cause substantial cascading. The hot spent shale thus transfers some of its heat to the intimately mixed fresh shale causing the net mixture temperature to approach 900° F. to 1100° F. so that shale oil vapor and high heating value gas are emitted from the fresh shale, passing through inlet opening 4 into product duct 29 and thence to further processing outside of the scope of the present invention. While the product gas is in contact with the absorbent in the feedstock, in this example limestone or dolomite, some of its hydrogen sulfide content reacts with said absorbent, forming calcium and magnesium sulfides and thus reducing the $H_2S$ content and in turn reducing the amount of $H_2S$ which must be ultimately removed.

As chamber 1 continues to rotate, retorted shale mixed with limestone or dolomite enters chute inlet opening 25, passes through intercompartmental transfer chute 23, and out of outlet opening 26 into combustion section 7, where it meets a stream of preheated combustion air at about 1100° F. which issues from air ducts 30. These air ducts 30 permit preheated air to pass from solids cooler/air preheater section 8 to combustion section 7. FIG. 2 depicts a view of the rotating chamber 1 looking toward the raw shale feed end. This cross-section is taken approximately through the mid-length of combustion section 7 and shows the arrangement of rotating chamber, lifters 18 and preheated air ducts 30. Upon meeting the stream of preheated air and upon exposure to the high temperatures in the combustion section 7, the retorted shale is autoignited and any remaining volatiles and residual carbon begin to burn. The solids are lifted and cascaded by means of lifters 18 through the hot gases establishing what is termed herein "mechanical fluidization" and maintaining a temperature of approximately 1200° F. to 1600° F. To achieve satisfactory mechanical fluidization of the cascading solids, the speed of rotation of cylindrical chamber 1 may be described by the following empirical equation set forth in the above description. For this example, with an internal diameter of 20 feet, the speed of rotation would be about 8 revolutions per minute.

In the combustion section 8, sulfur oxides are formed by oxidation of the remaining sulfur impurities in the retorted shale and by the decomposition of the sulfide compounds present in the absorbent. In this example, the sulfide compounds would be calcium and magnesium sulfides formed in the retort section 6. In the mechanically fluidized stream and at the temperatures of 1200° F. to 1600° F. in combustion section 7, the sulfur oxides react with the absorbent forming calcium and magnesium sulfite which are in turn oxidized to calcium and magnesium sulfates. By this means, the sulfur oxides are effectively removed from the exhaust gases. Typically, 75 to 90 percent of the sulfur oxides in the gas stream can be removed by the addition of limestone or dolomite as an absorbent. As the solids move toward the discharge end of the combustion section 7, cocurrently with the combustion air, they eventually reach a point where lifters 18 do not extend and this section without lifters acts as a disengaging section for separation of solids from the flue gases formed by the combustion. Near the discharge end of combustion section 7, a large portion of the spent shale, at 1200° F. to 1600° F. and containing also the spent absorbent, enters the inlet opening 21 of recycle duct 20 for recycle to the retort section 6. The remainder of the spent shale enters inlet opening 27 of intercompartmental duct 24 and is discharged into the solids cooler/air preheater section 8 through discharge opening 28. Typically, the spent shale recycle constitutes about 75 to 85 percent of the total spent shale. Flue gases leave the combustion section 7 through flue gas duct 11 from whence they leave the apparatus.

The spent shale plus spent absorbent which enters the solids cooler/air preheater section 8 meets the combustion air stream and travels countercurrently to it, being mechanically fluidized by lifters 18 which lift and cascade it through the air stream. By this means, the incoming air stream which enters through duct 15 is preheated to about 1100° F. while cooling the spent shale to about 600° F. Some additional heat is transferred to the incoming air from the flue gas duct 11 which passes through this section. Spent shale plus spent absorbent falls into discharge chute 16 from whence it leaves the apparatus.

In this example with an internal chamber diameter of 20 feet, the retort section 6 would be typically about 20 feet long, the combustion section 7 would be typically about 40 feet long, and the solids cooler/air preheater section 8 would be about 20 feet long. These dimensions are for typical western shales and may vary considerably with different analyses of feedstock materials such as eastern shale, oil and tar sands, coal shale, coal tailings, and other hydrocarbon-containing minerals.

Figure 3:
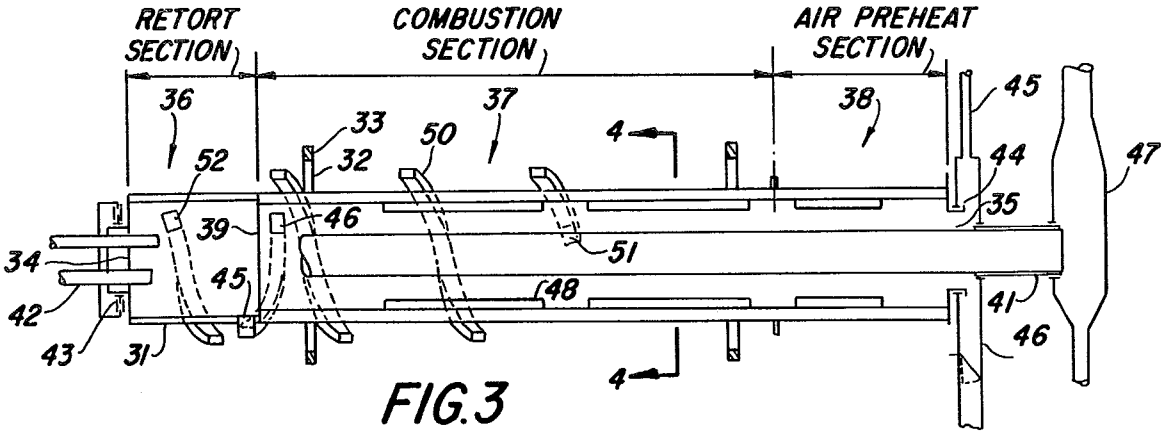
FIG. 3 is a side elevation of another retorting apparatus of this invention wherein the combustion air is designed to travel in a countercurrent manner with respect to spent shale in the combustion section. This elevation is shown in cross-section taken through the longitudinal axis of the cylinder by a vertical plane.

FIG. 3 depicts another apparatus of the present invention which differs from the example of FIG. 1 in that the combustion air travels countercurrent to the spent shale in the combustion section. Again cylindrical chamber 31 is supported by tires 32 on trunnions 33 and is equipped with a conventional variable-speed driving means. The chamber 31 is provided with a feed opening 34 and discharge opening 35. The chamber 31 is divided into a retorting section 36, a combustion section 37, and a solids cooler/air preheater section 38. The retort section 36 is separated from the combustion section 37 by a solid intercompartmental divider 39, but there is no physical divider between the combustion section 37 and the solids cooler/air preheater section 38. Chute 42 delivers oil shale, for example, and, if necessary, other solid materials to the apparatus. A conventional rotating seal 43 closes and seals opening 34 from the outside atmosphere. Similarly rotating seal 44 seals opening 35 at stationary air duct 45. Another seal seals the rotating flue gas duct 41 at the opening to stationary flue gas stack 47. The seals are of conventional type. Decarbonized spent shale is discharged through chute 46.

The retort section 36 is insulated on the outside with a suitable insulating material of a conventional type used to conserve heat within. The combustion section 37 and the solids cooler/air preheater sections are lined with a refractory heat-resistant material of a type suitable to withstand the maximum combustion temperatures therein. A recirculation means consisting of at least one helical chute 50 is mounted along the outside wall of chamber 31 and is open ended at its inlet end 51 and outlet end 52. The helical chute curves around chamber 31 in a direction counter to the direction of rotation so that material entering inlet 51 is carried back toward feed opening 34 until it is discharged through outlet 52 into the retort section 36. Lifters 48 are attached to the interior wall of the combustion section 37 and the solids cooler/air preheater section 38 and project perpendicularly from said wall. The lifters 48 are oriented parallel to the axis of rotation and, with the exceptions noted, extend almost the whole length of these sections. There is a short distance with no lifters at the front end of the combustion section 37, however, to prevent solid from entering flue gas duct 41 which has its entry opening at that location. There are also no lifters 48 for a short distance in the vicinity of the inlet opening 51 of the recycle chute 50 to prevent interference with solids pickup at this point.

Figure 4:
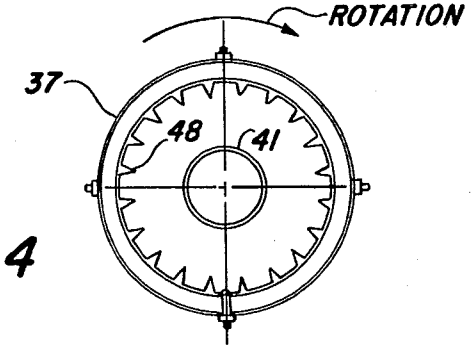
FIG. 4 is an end elevation of FIG. 3 in cross-section taken approximately through the mid-point of the cylinder looking toward the raw shale feed end along the line 4—4.

FIG. 4 depicts a view of FIG. 3 through the chamber 31 looking toward the raw shale feed end. This cross-section is taken approximately through the mid-length of combustion section 37 and shows the lifters 48, and flue gas duct 41.

Finally, there are no lifters for a short distance at the discharge of the solids cooler/air preheater section 38 for the purpose of disengaging the solids from the incoming air stream. A helical intercompartmental chute 46 is mounted on the outside of chamber to permit transfer of solids between the retort section 36 and the combustor section 37 through the inlet 45 in the same manner as described above for FIG. 1. This chute 46 is arranged with conventional devices (not shown) which permit solids to pass but prevent gases from passing through them. Recycle chute 50 has a conventional means (not shown) for adjustment of the size of its inlet opening 51.

The principles of operation of the retort section 36 are precisely the same as those described for FIG. 1 above. Similarly to that embodiment of the present invention, the feed may be mixed if necessary (as in processing eastern shales) with a suitable absorbent, in this example limestone or dolomite, for removal of sulfur oxides from the gases in the combustion section 37 and for partial removal of hydrogen sulfide from the high heating value product gas generated in the retort section. Lifters 48 in the combustions section 37 and the solids cooler/air preheater section 8 serve to lift and cascade solids down through the stream of gases therein. Mechanical fluidization is achieved by maintaining the speed of rotation of chamber 31 in accordance with the above empirical formula and parameters shown in the description of FIG. 1. Inlet air enters the apparatus through air duct 35 and travels through discharge opening 35 into the solids cooler/air preheater section 38, thence travelling countercurrently to the solids moving through this section and the combustion section 37. In this manner, the air with highest oxygen content comes in contact with the shale having the lowest carbon content, thus increasing the driving force for carbon burnout in the spent shale. As the air moves countercurrently it is intimately contacted by solids which cascade down through it and are, as previously described mechanically fluidized and, in so doing, burns the residual carbon in the retorted shale, until the resulting flue gases reach the entry opening of flue gas duct 11, through which they leave the apparatus. Decarbonized spent shale and spent absorbent, in this example spent limestone or dolomite, leave the apparatus through discharge chute 46.

The temperature in the combustion section 37 is maintained at 1200° F. to 1600° F. and spent shale is recycled to the retort section 36 at this temperature to establish a retorting temperature of 900° F. to 1000° F. Decarbonized spent shale is discharged from the apparatus at about 600° F. In this example, the retort section 36 has an internal diameter of about 3 feet while the combustion section 37 and the solids cooler/air preheater section have an internal diameter of 2 feet 6 inches. The retort section 36 is approximately 3 feet long. The combined combustion section 37 and solids cooler/air preheater section 38 has a length of approximately 16 feet. Of this, the length of the combustion section 37 is approximately 12 feet, although there is no sharp line of demarcation between these sections. The speed of rotation for this diameter is approximately 22 revolutions per minute. This example is typical for eastern shale and may vary considerably for other hydrocarbon-containing feedstocks.

Figure 5:
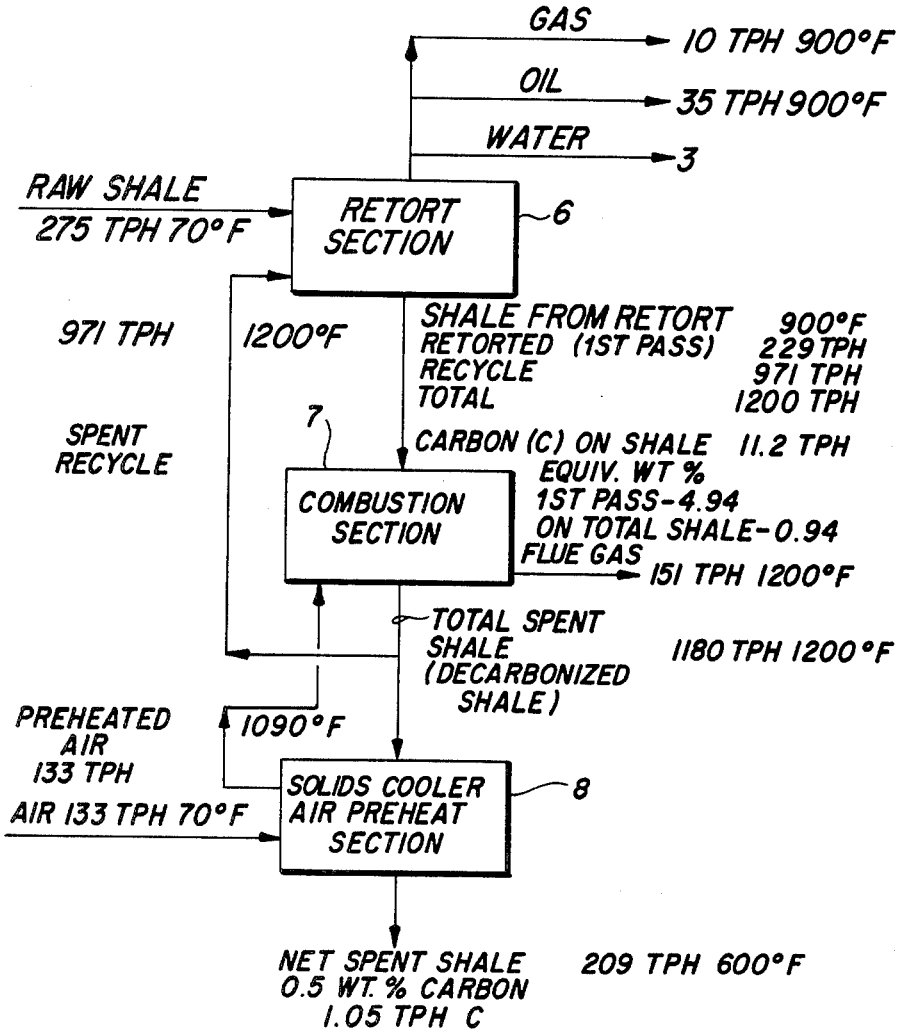
FIG. 5 is a flow sheet describing a system wherein the present invention is used to retort western oil shales for the purpose of recovering shale oil and high heating value gas, and wherein the combustion air travels cocurrently with the burning solids in the combustion section.

FIG. 5 depicts a block-type flowsheet showing the application of the present invention to the processing of a typical western oil shale for the purpose of recovering shale oil and high heating value gas. The feedstock is a Green River oil shale with a Fischer assay of 33 gallons per ton and is typical of western shales. Analytical information for this shale is given in Tables I, II and III below.

TABLE I*

Analysis of Typical Green River Shale (Fischer Assay 33 Gallons per Ton)

| Component | Percentage |
|---|---|
| Organic Material | 20.53 |
| Minerals | 79.47 |

TABLE II*

Typical Analysis of Minerals in Green River Shale (Fischer Assay 33 Gallons per Ton)

| Component | Weight Percent |
|---|---|
| Dolomite | 32 |
| Calcite | 16 |
| Quartz | 15 |
| Illite | 19 |
| Albite | 10 |
| Microcline | 6 |
| Pyrite | 1 |
| Analcite | 1 |

TABLE III*

Chemical Analysis of Kerogen

| Component | Weight Percent Organic Component |
|---|---|
| Carbon | 80.52 |
| Hydrogen | 10.30 |
| Nitrogen | 2.39 |
| Sulfur | 1.04 |
| Oxygen | 5.75 |

*(Atwood, M.T., "The Production of Shale Oil", Chemtech, October 1973, Pages 617–621)

In FIG. 5, 275 short tons per hour (designated herein as TPH) at 70° F. are fed to the retort section 6 of a 20-foot internal diameter rotary retorting apparatus as described in FIG. 1 of the present invention. In the retort section 6, the raw shale mixes with 971 TPH of recycled spent shale at 1200° F. (a 3.5 to 1 recycle ratio) to give a retorting temperature of 900° F. At this temperature, 10 TPH of gas, 35 TPH of crude shale oil vapor, and 3 TPH of water vapor are released from the raw shale and these products leave the retort section to be sent to a condenser (not shown). These products are contaminated with $H_2S$ in the retort section because of the sulfur impurities in the raw shale, but a portion of the $H_2S$ in the gas is absorbed by the calcium and magnesium oxides in the recycle spent shale. The product gas has a higher heating value of about 800 Btu per cubic foot.

The retorted shale leaving the retort section 6 consists of about 229 TPH of first-pass retorted shale (from the raw shale feed) plus 971 TPH of recycle spent shale for a total of 1200 TPH which enters the combustion section 7. The average carbon content of this mixture is about 0.94 weight percent, but the newly retorted shale portion averages about 4.94 weight percent carbon. In an apparatus with cocurrent air flow in the combustion section 7, 133 TPH of combustion air at 1090° F. meets the 1200 TPH of retorted shale at the feed end of combustion section 7. The resulting heat of combustion of the residual carbonaceous residue in the retorted shale raises the temperature of the retorted shale and the flue gases formed to about 1200° F. As the retorted shale travels through the combustion section 7, its average carbon content drops to about 0.5 weight percent. At the end of the combustion section, the spent shale is divided into a recycle stream of 971 TPH and a net spent shale stream of 209 TPH. The recycle shale returns to the retort section and the net spent shale goes forward to the solids cooler/air preheater section 8. In the solids cooler/air preheater section 8, 133 TPH of ambient air at 70° F. travels countercurrently to the 209 TPH of spent shale at 1200° F., thereby heating the air to 1090° F. while cooling the spent shale to 600° F. The spent shale, containing approximately 1.05 TPH of carbon (0.5 weight percent) leaves the apparatus for disposal. The apparatus in which the quantities of material shown in FIG. 5 are processed would have an internal diameter of about 20 feet. The retort section would be about 20 feet long while the lengths of the combustor section and the solids cooler/air preheater section would be 40 feet long and 20 feet long, respectively. The drum would rotate at 7 to 8 revolutions per minute in accordance with the empirical formula described herein.

Figure 6:
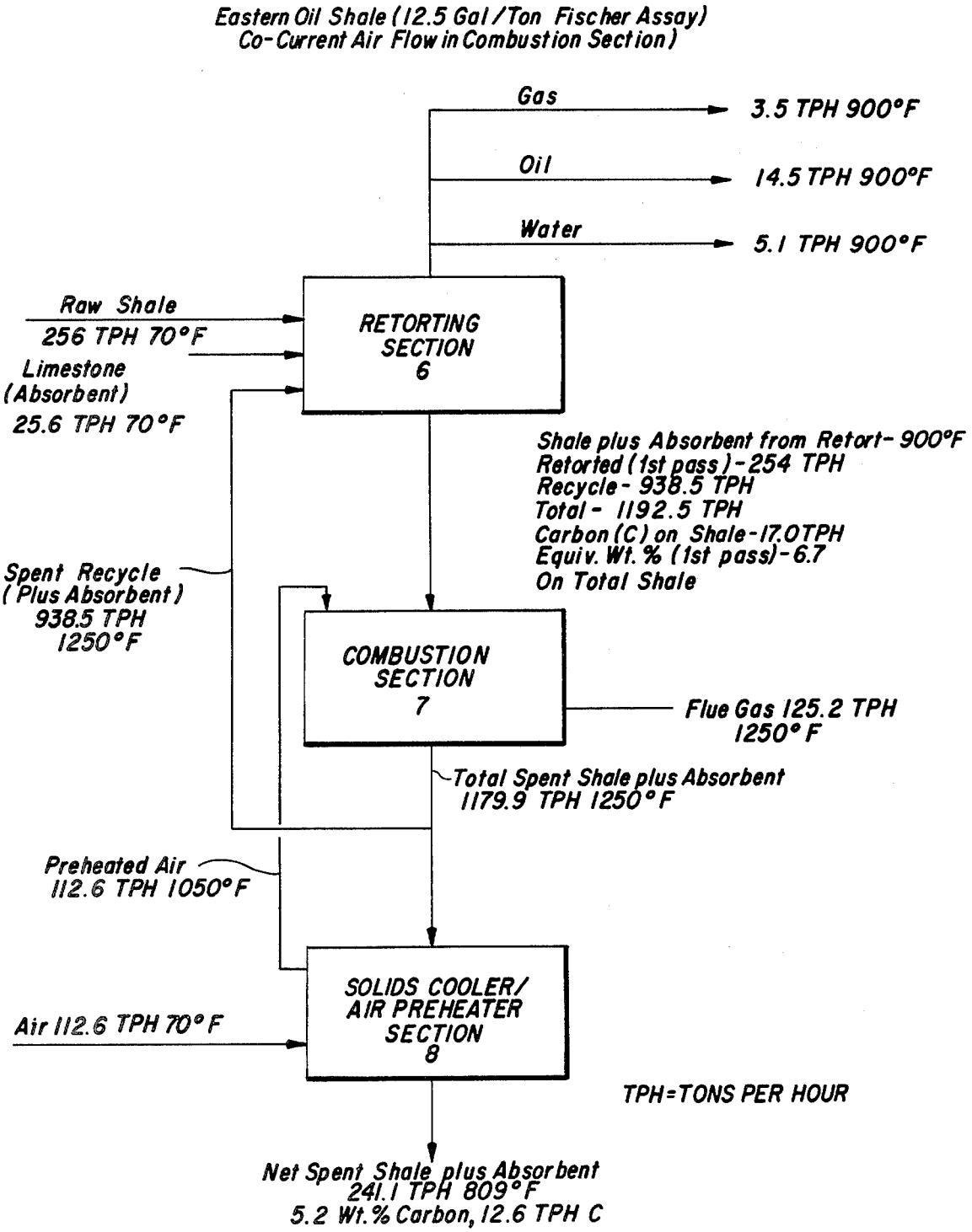
FIG. 6 is a flowsheet describing a system wherein the present invention is used to retort eastern oil shales for the purpose of recovering shale oil and high heating value gas, and wherein the combustion air travels cocurrently with the burning solids in the combustion section.

FIG. 6 is a block-type flowsheet showing the application of the present invention to the processing of a typical eastern United States oil shale for the purpose of recovering shale oil and high heating value gas. In this example, combustion air travels concurrently with the solids in the combustion section. The feedstock is a Kentucky oil shale with a kerogen content as shown in Table IV and a Fischer assay of 12.5 gallons per ton.

TABLE IV

Analysis of Typical Kentucky Shale (Fischer Assay = 12.5 Gallons per Ton)

| Component | Percentage |
|---|---|
| Organic Material | 18.8 |
| Minerals | 81.2 |

As is characteristic of eastern United States shales, the minerals in this feedstock do not contain a high enough calcite, limestone, or dolomite content to completely control sulfur oxide emissions. In this description, therefore, it is referred to as a "non-calcite-containing" shale. Thus, supplemental limestone or dolomite, for example, must be added. In FIG. 6, 256 short tons per hour of raw shale (designated herein as TPH) at 70° F. and 25.6 TPH of limestone (absorbent) are fed to the retort section 6 of an 18.5-foot internal diameter rotary retorting apparatus as described in the present invention. In the retort section 6, the raw shale plus absorbent mixes with 938.5 TPH of recycled spent shale plus absorbent at 1,250° F. (a 3.3 to 1 recycle ratio) to give a retorting temperature of 900° F. At this temperature, 3.5 TPH of gas, 14.5 TPH of crude shale oil vapor, and 5.1 TPH of water vapor are released from the raw shale and these products leave the retort section to be sent to a condenser (not shown). These products are contaminated with $H_2S$ in the retort section because of the sulfur impurities in the raw shale, but a portion of the $H_2S$ in the gas is adsorbed by the calcium and magnesium oxides in the absorbent. The product gas has a higher heating value of about 800 Btu per cubic foot. The retorted shale leaving the retort section 6 consists of about 254 TPH of first-pass retorted shale (from the raw shale feed) plus absorbent plus 938.5 TPH of recycle spent shale plus absorbent for a total of 1192.5 TPH which enters the combustion section 7. The average carbon content of this mixture is about 1.4 weight percent, but the newly retorted shale portion averages about 6.7 weight percent carbon. In the apparatus of this example, with cocurrent air flow in the combustion section 7, 112.6 TPH of combustion air at 1050° F. meets the 1192.5 TPH of retorted shale plus absorbent at the feed end of combustion section 7. The resulting heat of combustion of the residual carbonaceous residue in the retorted shale raises the temperature of the retorted shale plus absorbent and the flue gases formed to about 1250° F. As the retorted shale travels through the combustion section 7, its average carbon content drops to about 5.2 weight percent. At the end of the combustion section, the spent shale is divided into a recycle stream of 938.5 TPH and a net spent shale plus absorbent stream of 241.1 TPH. The recycle shale plus absorbent returns to the retort section and the net spent shale plus absorbent goes forward to the solids cooler/air preheater section 8. In the solids cooler/air preheater section 8, 112.6 TPH of ambient air at 70° F. travels countercurrently to the 241.1 TPH of spent shale plus absorbent at 1250° F., thereby heating the air to 1050° F. while cooling the spent shale to 809° F. The spent shale, containing approximately 12.6 TPH of carbon (5.2 weight percent) leaves the apparatus for disposal. The apparatus in which the quantities of material shown in FIG. 6 are processed would have an internal diameter of about 18.5 feet. The retort section would be about 20 feet long while the lengths of the combustor section and the solids cooler/air preheater section would be about 40 feet long and 20 feet long, respectively. The drum would rotate at 7 to 9 revolutions per minute in accordance with the empirical formula described herein.

FIG. 7 is a block-type flowsheet showing the application of this invention to a feedstock of the same analysis as FIG., 6, except that in this example the combustion air travels countercurrently to the solids in the combustion section. In FIG. 7, 275 short tons per hours (designated herein as TPH) at 70° F. and 27.5 TPH of limestone (absorbent) are fed to the retort section 36 of an 18.5-foot internal diameter rotary retorting apparatus as described in the present invention. In the retort section 37, the raw shale plus absorbent mixes with 1008.3 TPH of recycled spent shale at 1250° F. (a 3.5 to 1 recycle ratio) to give a retorting temperature of 900° F. At this temperature, 3.8 TPH of gas, 15.6 TPH of crude shale oil vapor, and 5.4 TPH of water vapor are released from the raw shale and these products leave the retort section to be sent to a condenser (not shown). These products are contaminated with $H_2S$ in the retort section because of the sulfur impurities in the raw shale, but a portion of the $H_2S$ in the gas is absorbed by the calcium and magnesium oxides in the absorbent. The product gas has a higher heating value of about 800 Btu per cubic foot. The retorted shale leaving the retort section 36 consists of about 272.9 TPH of first-pass retorted shale (from the raw shale feed) plus absorbent plus 1008.3 TPH of recycle spent shale plus absorbent for a total of 1281.2 TPH which enters the combustion section 37. The average carbon content of this mixture is about 1.4 weight percent, but the newly retorted shale portion averages about 6.7 weight percent carbon. In the apparatus of this example, with countercurrent air flow in the combustion section 37, 112.6 TPH of combustion air at 1050° F. meets the 1281.2 TPH of retorted shale plus absorbent at the feed end of combustion section 37. The resulting heat of combustion of the residual carbonaceous residue in the retorted shale raises the temperature of the retorted shale plus absorbent and flue gases formed to about 1250° F. As the retorted shale travels through the combustion section 37, its average carbon content drops to about 5.7 weight percent. At the combustion section, the spent shale is divided into a recycle stream of 1008.3 TPH and a net spent shale plus absorbent stream of 260 TPH. The recycle shale plus absorbent returns to the retort section and the net spent shale plus absorbent goes forward to the solids cooler/air preheater section 38. In the solids cooler/air preheater section 38, 112.6 TPH of ambient air at 70° F. travels countercurrently to the 260 TPH of spent shale at 1250° F., thereby heating the air to 1050° F. while cooling the spent shale to 840° F. The spent shale, containing approximately 13.8 TPH of carbon (5.7 weight percent) leaves the apparatus for disposal.

Figure 8:
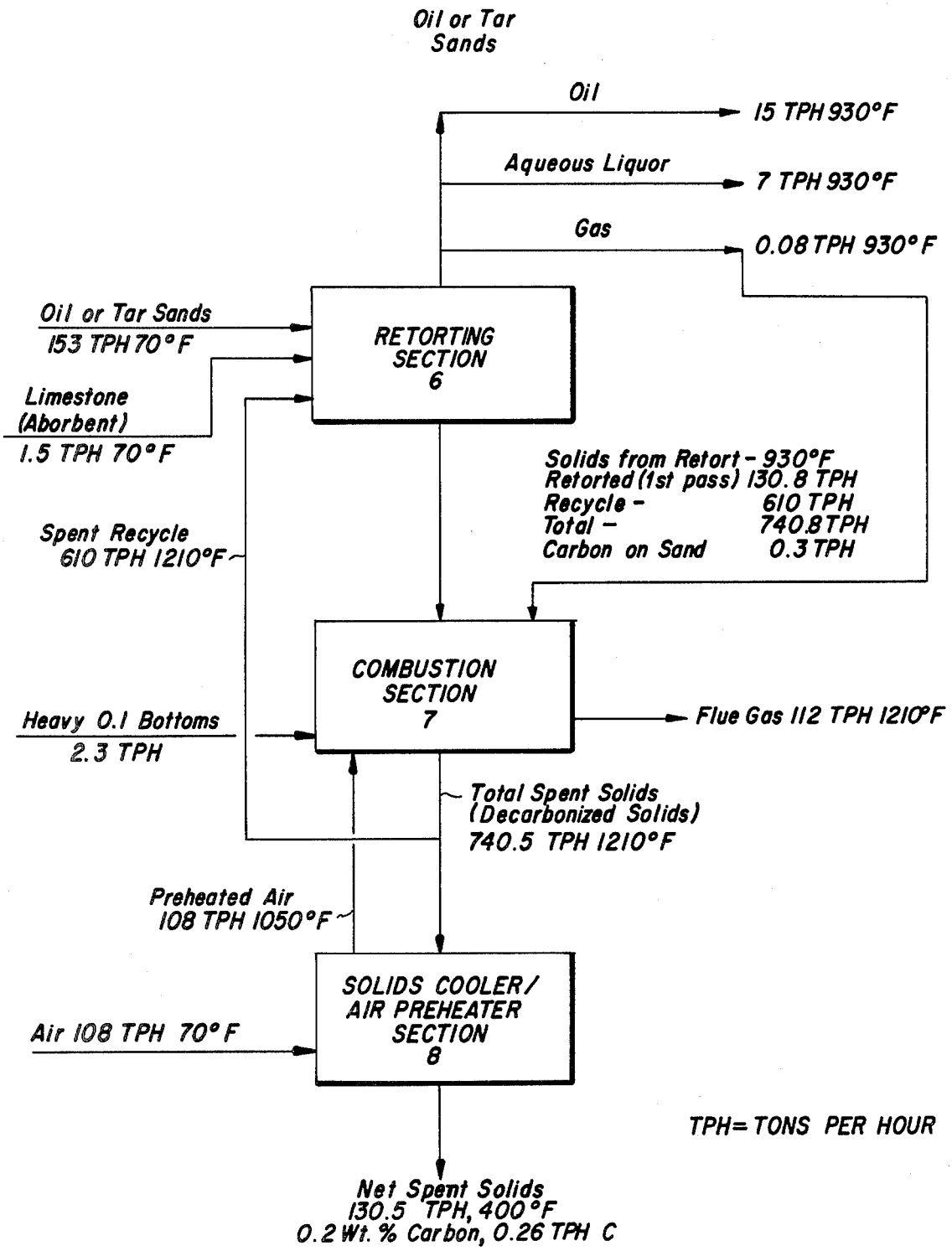
FIG. 8 is a flowsheet describing a system wherein the present invention is used to retort oil and/or tar sands for the purpose of recovering oil and high heating value gas.

FIG. 8 is a block-type flowsheet showing the application of the present invention for the purpose of recovering oil from oil or tar sands. The bitumen content of the Athabasen oil sand used in this examples is 11.5 percent. Very little gas is produced under the conditions of this example and all of the gas is burned in the combustion section, where it provides a portion of the heat required for retorting. The remaining heat requirement is supplied in this example by heavy oil bottoms taken from a refining step outside the scope of this invention. In FIG. 8, 153 short tons per hour (designated herein as TPH) at 70° F. and 1.5 TPH of limestone (absorbent) are fed to the retort section 6 of an 18.5-foot internal diameter rotary retorting apparatus as described in the present invention. In the retort section 6, the oil or tar sand plus absorbent mixes with 610 TPH of recycled spent solids at 1210° F. (a 4 to 1 recycle ratio) to give a retorting temperature of 930° F. At this temperature 0.08 TPH of gas, 15 TPH of crude shale oil vapor, and 7 TPH of water vapor are released from the oil or tar sand and these products leave the retort section to be sent to a condenser (not shown). These products are contaminated with $H_2S$ in the retort section because of the sulfur impurities in the raw oil sand, but a portion of the $H_2S$ in the gas is absorbed by the calcium and magnesium oxides in the recycle. The retorted sand plus absorbent leaving the retort section 6 consists of about 130.8 TPH of first-pass retorted solids (from the raw sand feed) plus 610 TPH of recycle spent solids for a total of 740.8 TPH which enters the combustion section 7. In the apparatus of this example, with cocurrent air flow in the combustion section 7, 108 TPH of combustion air at 1050° F. meets the 740.8 TPH of retorted solids at the feed end of combustion section 7. The resulting heat of combustion of the residual carbonaceous residue in the retorted solids raises the temperature of the retorted solids and the flue gases formed to about 1210° F. The retort gas of 0.08 TPH and 2.3 TPH of supplemental heavy oil bottoms from the downstream refining step are added as combustion section fuel. At the end of the combustion section, the spent solids are divided into a recycle stream of 610 TPH and a net spent solids stream of 130.5 TPH. The recycle solids return to the retort section and the net spent solids go forward to the solids cooler/air preheater section 8. In the solids cooler/air preheater section 8, 108 TPH of ambient air at 70° F. travels countercurrently to the 130.5 TPH of spent solids at 1210° F., thereby heating the air to 1050° F. while cooling the spent solids to 400° F. The spent solids containing approximately 0.26 TPH of carbon (0.2 weight percent) leaves the apparatus for disposal.

Figure 9:
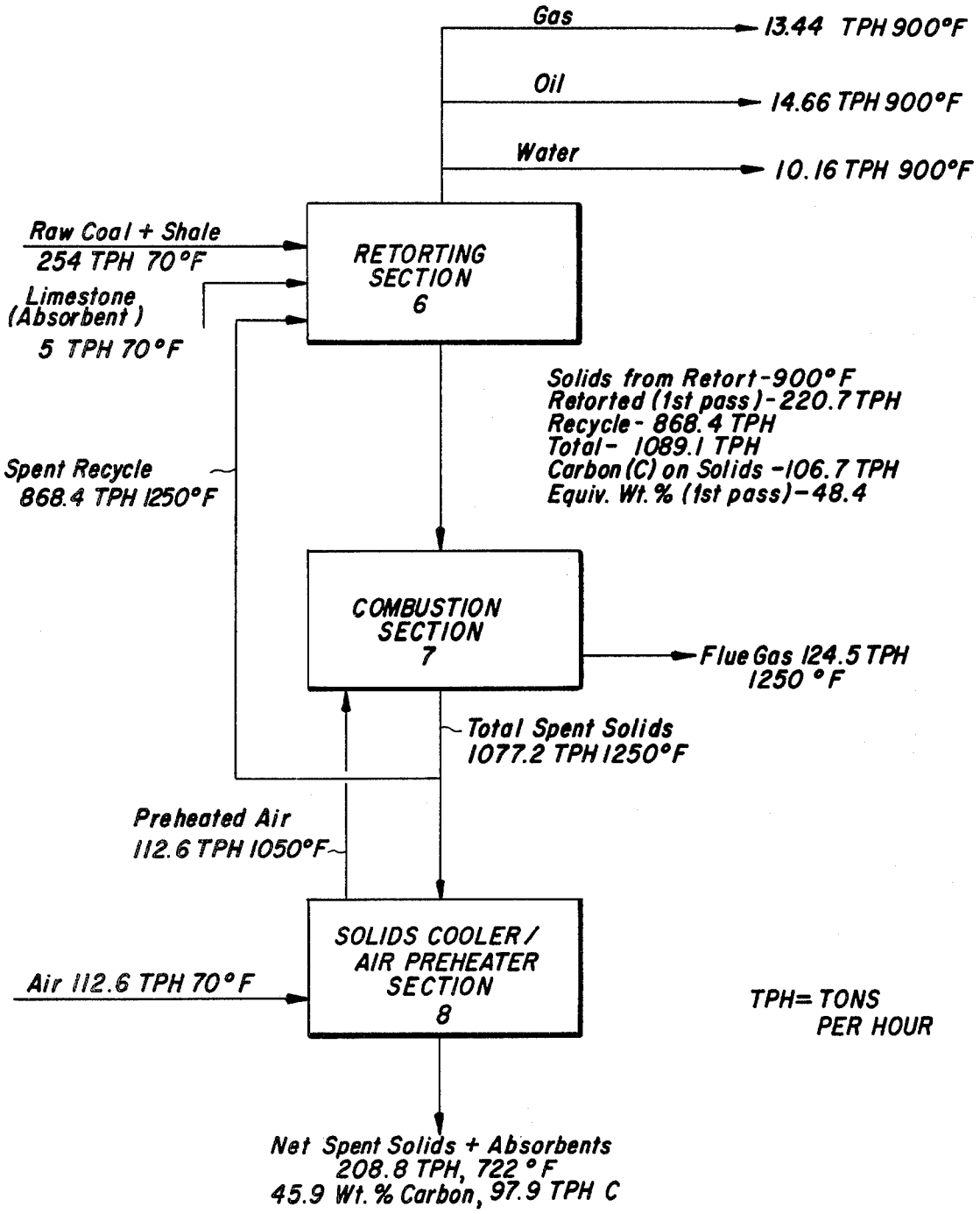
FIG. 9 is a flowsheet describing a system wherein the present invention is used to retort coal shale for the purpose of recovering hydrocarbons and high heating value gas.

FIG. 9 is a block-type flowsheet showing the application of the present invention to the retorting of coal shale for the purpose of recovering hydrocarbons and high heating value gas. The coal shale used in this example is characterized by the analyses of Tables V and VI.

TABLE V

| Analysis of Typical Coal Shale (Yield = 13.2 Gallons per Ton of Coal Liquids) | |
|---|---|
| Component | Weight Percent |
| Coal | 60 |
| Shale Minerals | 40 |

TABLE VI

| Analysis of Coal Fraction of Coal Shale | |
|---|---|
| Component | Weight Percent |
| Volatile Matter | 31.67 |
| Fixed Carbon | 55.78 |
| Sulfur | 0.73 |
| Ash | 8.00 |
| Moisture | 3.82 |

These analyses show the high carbon content of this material which can otherwise be defined as low-grade coal. Since the carbon content is greatly in excess of the amount needed, upon combustion, to supply the necessary retorting heat, a devolatilized coke product is produced. The parameters for this example have been chosen to give a high yield of coal liquids in the retort plus a coke suitable for burning in boilers, for example, to make steam. In FIG. 9, 254 short tons per hour (TPH) at 70° F. and 5 TPH of limestone (absorbent) are fed to the retort section 6 of an 18.5-foot internal diameter rotary retorting apparatus as described in the present invention. In the retort section 6, the raw coal shale plus absorbent mixes with 868.4 TPH of recycled spent shale at 1250° F. (a 3.35 to 1 recycle ratio) to give a retorting temperature of 900° F. At this temperature, 13.44 TPH of gas, 14.66 TPH of crude coal liquids, and 10.16 TPH of water vapor are released from the raw coal shale and these products leave the retort section to be sent to a condenser (not shown). These products are contaminated with $H_2S$ in the retort section because of the sulfur impurities in the raw shale, but a portion of the $H_2S$ in the gas is absorbed by the calcium and magnesium oxides in the absorbent. The product gas has a higher heating value of about 790 Btu per cubic foot. The retorted solids leaving the retort section 6 consists of about 229 TPH of first-pass retorted coal shale (from the raw coal shale feed) plus absorbent plus 868.4 TPH of recycle spent solids for a total of 1089.1 TPH of which about 106.7 TPH are carbon. In the apparatus of this example, with cocurrent air flow in the combustion section 7, 112.6 TPH of combustion air at 1050° F. meets the 1089.1 TPH of retorted solids at the feed end of combustion section 7. The resulting heat of combustion of the residual carbonaceous residue in the retorted solids raises the temperature of the retorted solids and the flue gases formed to about 1250° F. As the retorted solids travel through the combustion section 7, the average carbon content drops from about 48.4 weight percent to about 45.9 weight percent.

At the end of the combustion section, the spent solids are divided into a recycle stream of 868.4 TPH and a net spent solids stream of 208.8 TPH. The recycle solids return to the retort section and the net spent solids go forward to the solids cooler/air preheater section 8. In the solids cooler/air preheater section 8, 112.6 TPH of ambient air at 70° F. travels countercurrently to the 208.8 TPH of spent solids at 1250° F., thereby heating the air to 1050° F. while cooling the spent solids to 722° F. The spent shale, containing approximately 95.9 TPH of carbon (45.9 weight percent) leaves the apparatus for disposal.

Although the rotating chamber described herein is cylindrical, the principles of this invention do not require any specific shape and will, in fact, operate satisfactorily with any chamber having a regularly shaped cross-section area as, for example, a regular prism or a slender cone. In the latter case, the base of the cone might be at the discharge end of the combustion section, for cocurrent air flow in that section. This would provide a means for controlling the relative gas velocity by controlling the cross-section area. In this manner, the enlarged cross-section would result in a decreased gas velocity leading to greater settling of any entrained solids from the gas stream.

Having described the details of this invention, it is evident that it provides an arrangement and method for retorting oil shale or other hydrocarbon-containing minerals with certain advantages not heretofore attained in conventional arrangements. Although the description contained herein has been made with respect to relatively specific embodiments, it will become apparent to those of ordinary skill in this art that variations may be made and such are intended to be included without departing from the scope of this invention.

What is claimed is:

1. A method for retorting a feedstock of particulate solids having recoverable volatile hydrocarbon constitutents comprising introducing said feedstock solids into an elongated chamber rotating about a substantially horizontal axis having an inlet and an outlet, said chamber having at the upstream end a retorting section and a physically separate combustion section at the downstream end, said sections in horizontal series with one another with said feedstock enetering at said upstream end, passing said feedstock solids and recycled, hot, spent solids through said retorting section to provide retorted solids and volatilized hydrocarbons, recovering said volatilized hydrocarbons free of combustion section products, introducing said retorted solids into said combustion section, combusting said retorted solids by lifting and cascading said retorted solids through a moving stream of combustion supporting gas to form said hot, spent solids, and, recycling a portion of said hot spent solids upstream to said retorting section.

2. The method of claim 1 comprising lifting and cascading said retorted solids mixed with recycled spent solids through a moving stream of air introduced into said combustion section and burning any residual combustible material in said retorted solids.

3. The method of claim 2 comprising introducing the stream of air at a feed end for said solids into said combustion section for burning any of said residual combustible material.

4. The method of claim 2 wherein said chamber is provided with a combined solids cooler/air preheater section in said series after said combustion section and ambient combustion air is passed through said preheater section prior to introduction into said combustion section.

5. The method of claim 4 comprising recycling a portion of the hot spent solids from a downstream end of said combustion section to a feed end of said retorting section, transferring the remaining hot spent solids to a front end of said solids cooler/air preheater section, introducing ambient combustion air into a discharge end of said solids cooler/air preheater section, cooling said spent solids in a countercurrent flow of combustion air while simultaneously preheating said combustion air, transferring said preheated combustion air to an upstream end of said combustion section, and moving said spent solids from the discharge end of said solids cooler/air preheater section.

6. The method of claim 1 wherein said feedstock solids comprises a hydrocarbon-containing mineral.

7. The method of claim 6 further comprising introducing supplementary material selected from the group consisting of a solid carbonaceous fuel and gas, or mixtures thereof, to facilitate combustion of retorted solids in said combustion chamber.

8. The method of claim 6 wherein said feedstock solids are selected from the group consisting of a calcite-containing oil shale, a non-calcite-containing oil shale, oil sand, tar sand, coal shale, coal tailings, coal, wood, and mixtures thereof.

9. The method of claim 6 wherein said feedstock solids contain a metal carbonate or oxide for the removal of a compound selected from the sulfur-containing group consisting of hydrogen sulfide, sulfur oxides, and mixtures thereof.

10. The method of claim 9 wherein said carbonate or oxide is selected from the group consisting of limestone, dolomite, burnt lime, and mixtures thereof.

11. The method of claim 6 wherein said feedstock solids comprise a calcite-containing oil shale and a calcium or magnesium oxide is generated in situ for the removal of said sulfur-containing material.

12. The method of claim 10 wherein said feedstock solids further comprise a non-calcite containing oil shale.

13. The method of claim 6 wherein said feedstock solids comprise oil shale and volatilized oil is recovered from said retort section.

14. The method of claim 13 wherein said oil is recovered in essentially its vapor form,

15. The method of claim 13 wherein by-product gas is separated from said oil.

16. The method of claim 13 comprising adding superheated steam to said retorting section to increase the hydrogen content of the gas therein and thereby reduce the hydrogen requirements for subsequent hydro-treating of the oil for nitrogen and sulfur compound removal.

17. The method of claim 6 wherein the quantity of said recycled hot spent solids is such that a temperature of about 700° F. to about 1000° F. is achieved in said retorting section with a recycle temperature of about 1200° F. to about 1600° F. and a feedstock solids temperature of about room temperature.

18. The method of claim 6 wherein said feedstock solids comprise a mixture of particle sizes limited only by the means to accommodate transfer of said retorted solids mixed with said recycled spent solids to said combustion section.

19. The method of claim 6 wherein high thermal efficiency achieved by providing the retorting heat from the residual carbonaceous residue in the devolatilized feedstock.

20. The method of claim 6 wherein the temperature in the combustion section is maintained between about 1200° F. and 1600° F.

21. The method of claim 6 wherein said mineral contains a compound selected from the group consisting of silica, alumina, and mixtures thereof, which favors catalytic reactions in the retorting section.

22. The method of claim 1 wherein said retorted solids are lifted and cascaded in said combustion section while the chamber is rotating at a speed defined by the following empirical relationship:

$$\text{Revolutions per minute} = A\sqrt{\frac{3}{\text{inside diameter in feet}}}$$

in which A may have a value between about 10 and 40 such that gas is entrained by the cascading solids resulting in mechanical fluidization.

23. A continuous method for retorting a feedstock of particulate solids having recoverable volatile hydrocarbon constitutents comprising introducing said feedstock solids into an elongated chamber rotating about a substantially horizontal axis having an inlet and an outlet, said chamber having at the upstream end a retorting section, a physically separate combustion section at the downstream end, and a solids cooler/air preheater section connecting with said combustion section, said sections in horizontal series with one another with said feedstock entering at said upstream end, passing said feedstock solids and a recycled portion of hot, spent solids through said retorting section to provide retorted solids and volatized hydrocarbons recovering said volatilized hydrocarbons free of combustion section products, introducing said retorted solid into said combustion section, combusting said retorded solids by lifting and cascading retorted solids through a moving stream of preheated air to form hot, spent solid, separating said hot, spent solids to form said recycled portion of hot, spent solids and a remaining portion of hot, spent solids, passing said remaining portion of hot spent solids to said solids cooler/air preheater section where combustion air at ambient temperature is heated in countercurrent flow to said solids thus forming said preheated air stream introduced into the combustion section, and removing cooled, spent solids from said downstream end of said elongated chamber.

24. The method of claim 23 wherein said feedstock solids comprise a hydrocarbon-containing mineral.

25. The method of claim 24 wherein said feedstock solids comprising oil shale and volatilized oil is recovered from said retort section.

26. The method of claim 25 wherein by-product gas is separated from said oil.

27. The method of claim 23 wherein the quantity of said recycled hot spent solids is such that a temperature of about 700° F. to about 1000° F. is achieved in said retorting section with a recycle temperature of about 1200° F. to about 1600° F. and a feedstock solids temperature of about room temperature.

28. The method of claim 23 wherein said ambient combustion air is preheated to about 800° F. to 1100° F. while spent solids are cooled in said solids cooler/air preheater section to about 500° F. to 700° F. and wherein the spent solids entering said combustion section are at about 1200° F. to about 1600° F.

29. The method of claim 23 wherein the spent solids are discharged from said preheater section for direct cooling with water and generating superheated steam.

30. The method of claim 23 wherein said feedstock solids comprise a calcite-containing oil shale and a metal carbonate or oxide is generated in situ for the removal of said sulfur-containing material.

31. The method of claim 23 wherein high thermal efficiency is achieved by providing the retorting heat from a residual carbonaceous residue in the devolatilized feedstock.

* * * * *